US006986838B2

(12) United States Patent
Babic et al.

(10) Patent No.: US 6,986,838 B2
(45) Date of Patent: Jan. 17, 2006

(54) NANOMACHINED AND MICROMACHINED ELECTRODES FOR ELECTROCHEMICAL DEVICES

(75) Inventors: Davorin Babic, Marietta, GA (US); John M. Baxley, Marietta, GA (US); Paul D. Browne, Atlanta, GA (US)

(73) Assignee: Johnson Research & Development Co., Inc., Atlanta, GA (US)

( * ) Notice: Subject to any disclaimer, the term of this patent is extended or adjusted under 35 U.S.C. 154(b) by 0 days.

(21) Appl. No.: 10/918,250

(22) Filed: Aug. 13, 2004

(65) Prior Publication Data

US 2005/0279638 A1 Dec. 22, 2005

Related U.S. Application Data

(60) Provisional application No. 60/494,965, filed on Aug. 14, 2003.

(51) Int. Cl.
*C25D 5/34* (2006.01)

(52) U.S. Cl. ..... 205/210; 205/215; 205/221; 205/223; 205/233; 205/291; 205/324; 205/326

(58) Field of Classification Search ..... 205/223, 205/324, 215, 221, 233, 291, 326; 204/284, 204/292, 280
See application file for complete search history.

(56) References Cited

U.S. PATENT DOCUMENTS 4,970,094 A * 11/1990 Byrd ..... 427/126.5
6,231,744 B1 * 5/2001 Ying et al. ..... 205/324

* cited by examiner

*Primary Examiner*—Bruce F. Bell
(74) *Attorney, Agent, or Firm*—Baker Donelson

(57) ABSTRACT

A nanomachined and micromachined electrode (10) is disclosed that is produced by providing a layer of aluminum (11) positioned upon a conductive substrate (12), anodizing the layer of aluminum to produce a layer of aluminum oxide (13) having an array of pores (14), depositing a sacrificial metal (17) within the pores of the aluminum oxide layer, etching the aluminum oxide layer so as to leave an array of sacrificial metal rods (18), depositing a layer of electrode material (19) between the array of sacrificial metal rods, and etching the sacrificial metal rods so that a layer of copper remains having an array of pores (20) where the sacrificial metal rods had existed. The layer of copper is the electrode (10).

17 Claims, 4 Drawing Sheets

NANOMACHINED AND MICROMACHINED ELECTRODES FOR ELECTROCHEMICAL DEVICES

REFERENCE TO RELATED APPLICATION

This is a continuation-in-part of provisional application Ser. No. 60/494,965, filed Aug. 14, 2003 and entitled NANOMACHINED AND MICROMACHINED ELECTRODES FOR ELECTROCHEMICAL DEVICES.

TECHNICAL FIELD OF THE INVENTION

The present invention relates generally electrodes for electrochemical devices and to the method of manufacturing nanomachined and micromachined electrodes.

BACKGROUND OF THE INVENTION

Electrodes for electrochemical devices are critical elements of the devices. Proper device operation demands that the electrodes are highly electrically and thermally conductive, allow unimpeded transport of gases or liquids through the electrode and preferably provide mechanical support to the overall electrochemical device structure. The unimpeded transport requirement is achieved by fabricating a porous electrode. Reduction of solid electrolyte film thickness to 10 $\mu$m and below forces a reduction of the pore sizes to micron or even submicron range.

Porous electrodes have been produced through an electroplating process wherein the electrode is produced by electroplating upon an organic surfactant. This simple electroplating process however produces electrodes of irregular shape and random pore orientation and sizing, which will not work properly in electrochemical devices.

Accordingly, it is seen that a need remains for a manner to produce nanomachined electrodes, i.e., electrodes having generally regularly oriented and shaped pores with a diameter of less than one micron, and micromachined electrodes, i.e., electrodes having pores with a diameter of greater than or equal to one micron, for electrochemical devices. It is to the provision of such therefore that the present invention is primarily directed.

SUMMARY OF THE INVENTION

In a preferred form of the invention a nanomachined and micromachined electrode is produced in accordance to the method of providing a layer of aluminum positioned upon a conductive substrate, anodizing the layer of aluminum to produce a layer of aluminum oxide having an array of pores, depositing a sacrificial metal within the pores of the aluminum oxide layer, etching the aluminum oxide layer so as to leave an array of sacrificial metal rods, depositing a layer of electrode material between the array of sacrificial metal rods, and etching the sacrificial metal rods so that a layer of copper remains having an array of pores where the sacrificial metal rods had existed. The layer of copper is the electrode.

DETAILED DESCRIPTION

With reference next to the drawings, there is shown nanomachining and micromachining techniques which produce electrochemical device electrodes 10 with desired pore sizes, hereinafter referred to as nano-porous and/or micro-porous electrodes.

Figure 1:
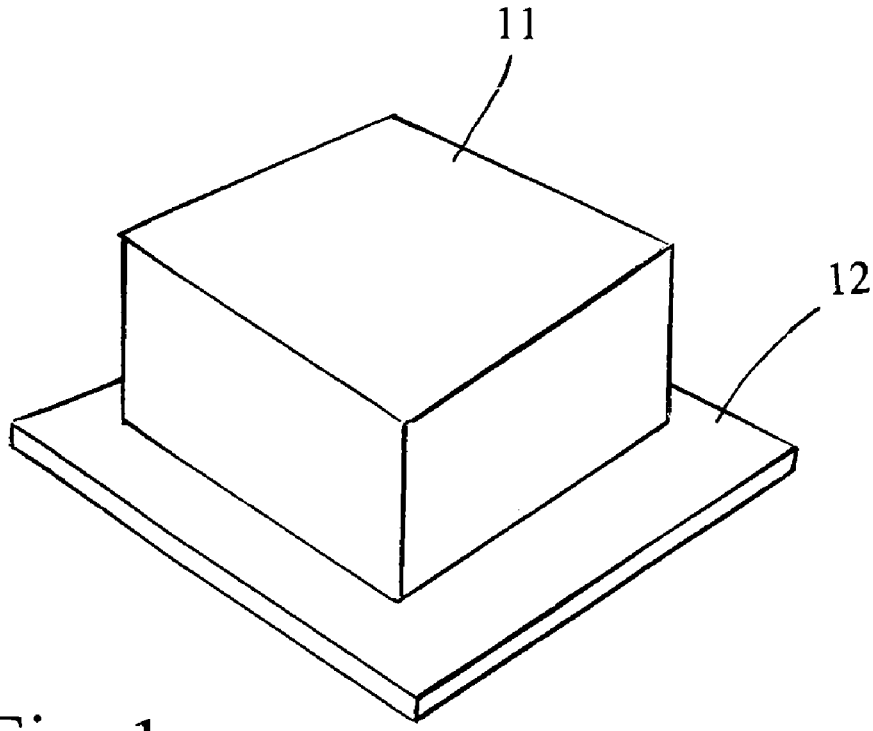
FIGS. 1–7 are a series of sequential perspective views showing the production of the electrode.
Figure 2:
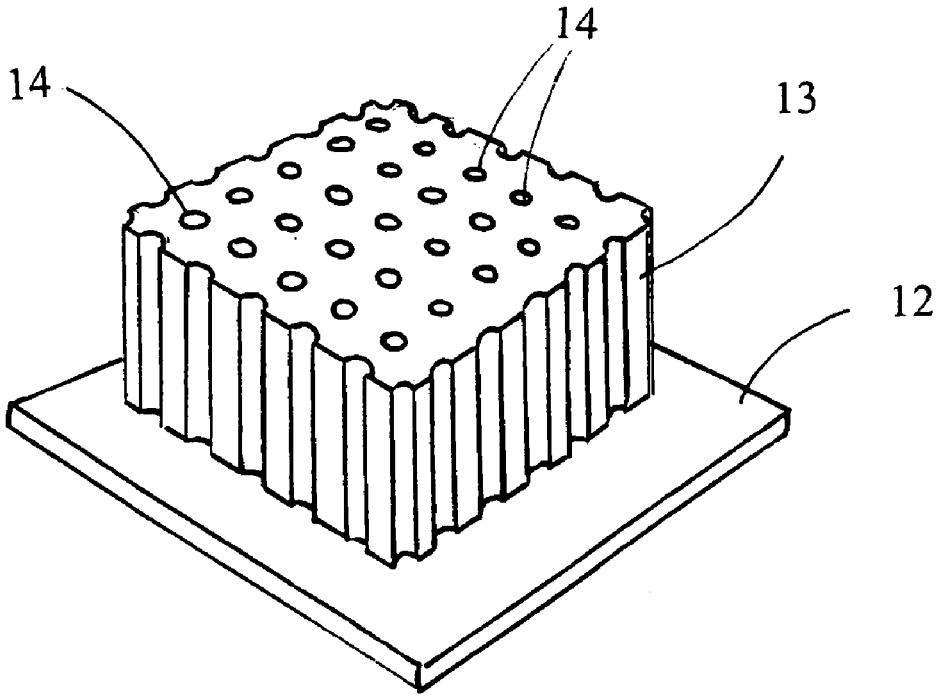

A preferred method of producing an electrode commences with positioning a layer or sheet of highly electropolished aluminum 11 upon a substrate 12, see FIG. 1. The substrate 12 is be made of a conductive metal, such as gold, platinum, or copper. The aluminum 11 is then anodized by immersing the aluminum sheet 11 and substrate 12 within a bath of phosphoric acid and oxalic acid, a weakly alumina etching solution, with a voltage of approximately 10 milliamps applied across the aluminum. The anodizing process oxidizes the aluminum 11 so that it is changed to a layer of aluminum oxide 13 or alumina $Al_2O_3$, see FIG. 2. This anodizing process also causes a self- assembled array of pores 14 to be formed or "etched" into the aluminum oxide layer 13. These pores 14 are very regular in shape, diameter and orientation. This self-assembled array of pores 14 serves as a patterning template for the further electrode fabrication steps. The self-assembled aluminum oxide pores 14 have pore diameters in the range of 50 nm or less. The pore diameter and spacing is controlled by the anodization voltage and solution composition and therefore both micromachined and nanomachined electrodes may be formed with the current process.

Figure 3:
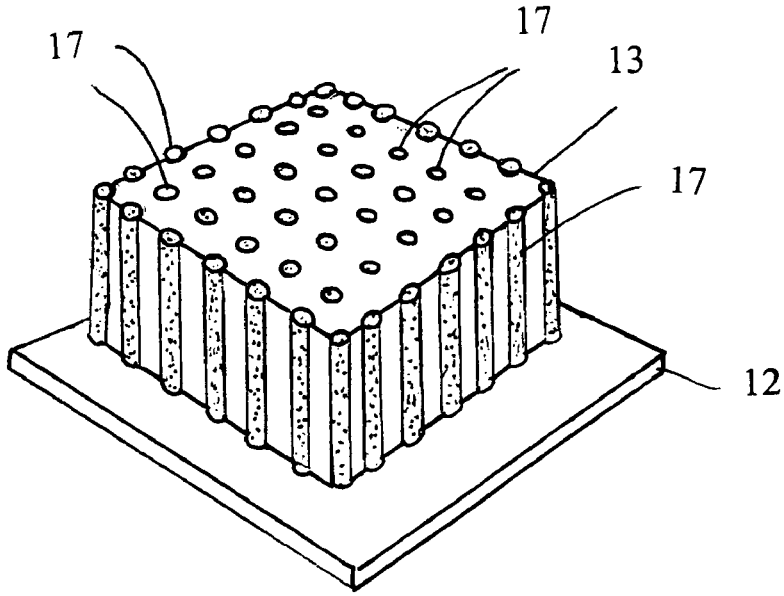

The next step in the nanomachining sequence is the positioning of the sacrificial metal 17, preferably aluminum and therefore referred hereafter as aluminum. A sacrificial metal 17, is deposited by a non-aqueous electroplating process into the aluminum oxide layer 13, this electroplating process builds the aluminum layer 17 from the substrate 12, upwardly in the drawings, to the top surface of the aluminum oxide layer 13, as shown in FIG. 3. In other words, the aluminum fills the pores 14 within the aluminum oxide layer 13 from the bottom up. The aluminum oxide layer 13 thus can be referred to as a mold or mask. It is believed that other sacrificial metal may be used as an alternative to aluminum, although such is not know at this time.

Figure 4:
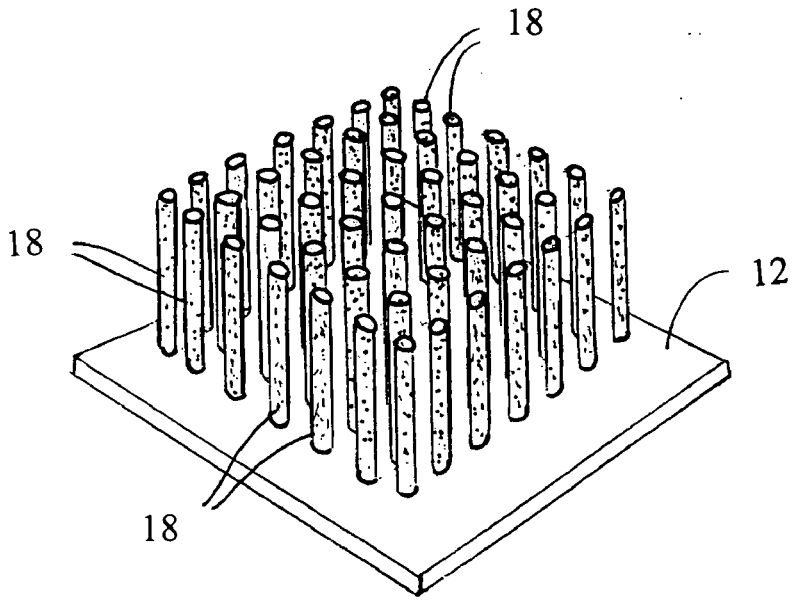
Figure 5:
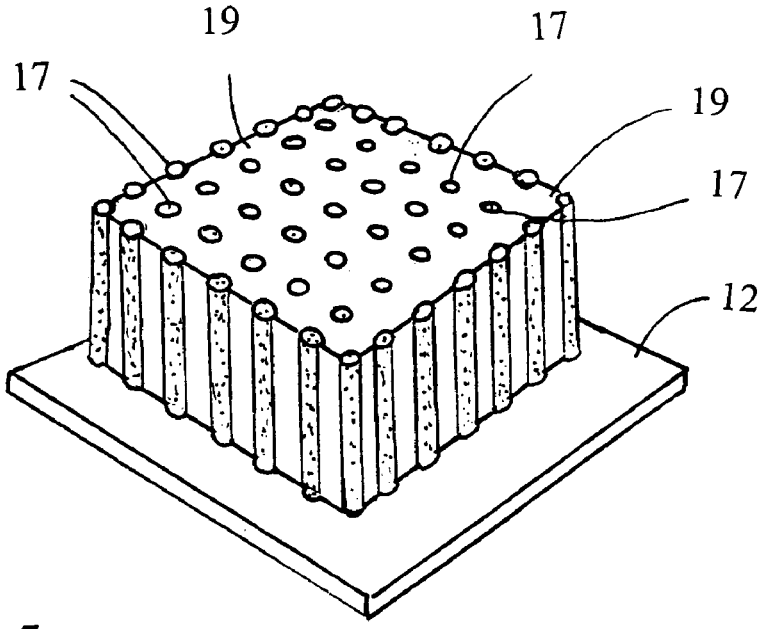

The aluminum oxide layer 13 is then etched away in a bath of phosphoric acid and chromic acid leaving tall aluminum columns 18, as shown in FIG. 4. To do this, the aluminum oxide layer 13 is placed in the bath for approximately thirty minutes at sixty degrees Celsius. Subsequently, an electrode metal 19, such as copper, nickel, platinum or any other metal, hereinafter referred to as copper for ease of explanation, is electroplated from an aqueous solution. The copper 19 is positioned between the aluminum columns 18 under the conditions that the copper 19 does not plate on the aluminum columns 18, as shown in FIG. 5. As such, the copper 19 fills the spaces between the aluminum columns 18.

Figure 6:
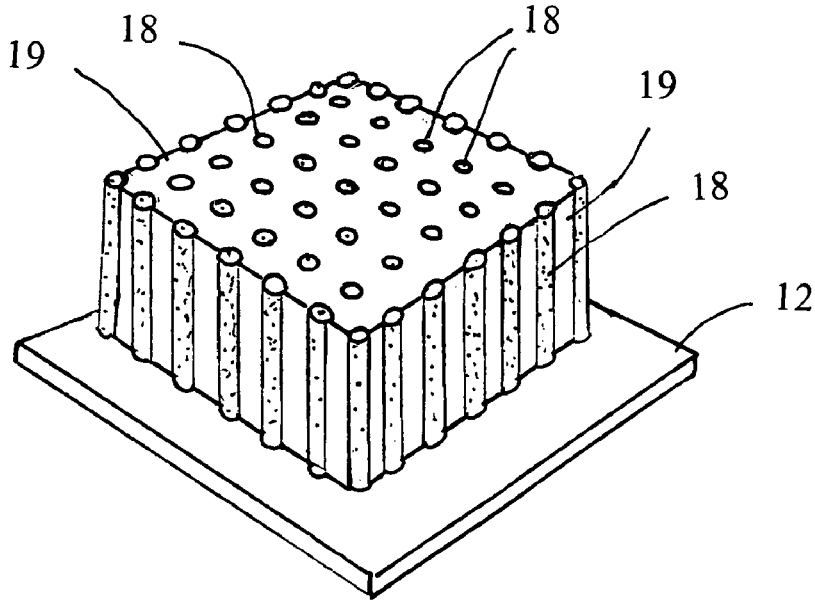
Figure 7:
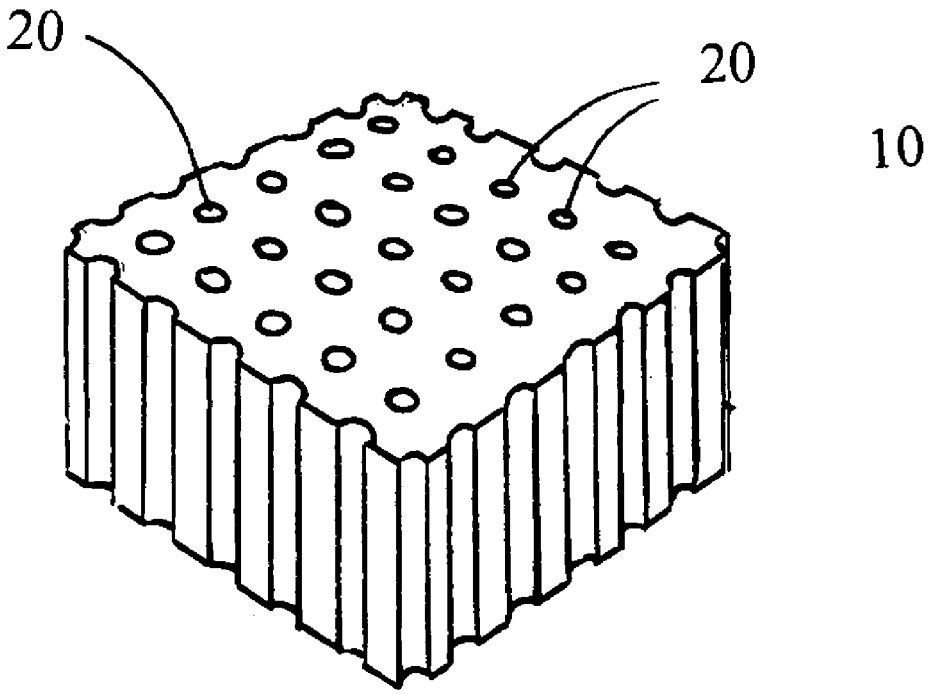

Finally, the aluminum columns 18 are etched away leaving a copper electrode 10 structure having an arranged array of nano and micro sized pores 20, as shown in FIG. 6. The aluminum may be etched away by immersing it into a bath of tetra methyl ammonium hydroxide, 25% by weight, for thirty minutes at a temperature of twenty degrees Celsius. Once the aluminum is completely etched away the remaining structure is a copper layer with pores 20 that correspond in shape, size and orientation to the pores originally formed in the aluminum layer 11. The copper layer is then removed from the underlying substrate, thus completing the formation of a porous copper electrode 10, shown in FIG. 7. The pores within the copper are therefore generally uniform in pattern, shape, size and orientation.

It should be understood that the term etching, as used herein, may refer also to other methods of removing metallic material known in the art.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A method of producing an electrode comprising the steps of:

(A) providing a layer of aluminum positioned upon a conductive substrate;

(B) anodizing the layer of aluminum to produce a layer of aluminum oxide having an array of pores;

(C) depositing a sacrificial metal within the pores of the aluminum oxide layer;

(D) etching the aluminum oxide layer so as to leave an array of sacrificial metal rods;

(E) depositing a layer of electrode material between the array of sacrificial metal rods; and (F) etching the sacrificial metal rods so that a layer of electrode material remains having an array of pores where the sacrificial metal rods had existed.

2. The method of claim 1 wherein step (C) the sacrificial metal is aluminum.

3. The method of claim 1 wherein step (C) the layer of sacrificial metal is deposited by an electroplating process.

4. The method of claim 3 wherein step (C) the electroplating process is a non-aqueous electroplating process.

5. The method of claim 3 wherein step (E) the electrode material is deposited by an electroplating process.

6. The method of claim 3 wherein step (D) the electrode material is deposited by an electroplating process.

7. The method of claim 1 wherein step (E) the electrode material is deposited by an electroplating process.

8. A method of producing an electrode comprising the steps of:

(A) providing a porous layer of aluminum oxide positioned upon a conductive substrate;

(B) depositing a sacrificial metal within the pores of the aluminum oxide layer;

(C) removing the aluminum oxide layer so as to leave an array of sacrificial metal rods;

(D) depositing a layer of electrode material between the array of sacrificial metal rods; and (E) removing the sacrificial metal rods so that a layer of electrode material remains having an array of pores where the sacrificial metal rods had existed.

9. The method of claim 8 wherein step (B) the sacrificial metal is aluminum.

10. The method of claim 8 wherein step (B) the layer of sacrificial metal is deposited by an electroplating process.

11. The method of claim 10 wherein step (B) the electroplating process is a non-aqueous electroplating process.

12. The method of claim 8 wherein step (D) the electrode material is deposited by an electroplating process.

13. The method of claim 8 wherein step (A) the porous layer of aluminum oxide is produced through the process of anodization of an aluminum layer.

14. The method of claim 8 wherein step (C) the aluminum oxide layer is removed through an etching process.

15. The method of claim 14 wherein step (E) the sacrificial metal is removed through an etching process.

16. The method of claim 8 wherein step (E) the sacrificial metal is removed through an etching process.

17. The method of claim 8 wherein step (D) the electrode material is copper.

* * * * *